United States Patent [19]

Walker

[11] Patent Number: 4,526,683

[45] Date of Patent: Jul. 2, 1985

[54] SOLIDS SEPARATOR

[76] Inventor: O. Neal Walker, 6111 Wade La., Knoxville, Tenn. 37166

[21] Appl. No.: 565,015

[22] Filed: Dec. 22, 1983

Related U.S. Application Data

[63] Continuation of Ser. No. 360,165, Mar. 22, 1982, abandoned.

[51] Int. Cl.[3] ..... B03B 5/00

[52] U.S. Cl. ..... 209/423; 210/360.2

[58] Field of Search ..... 209/423–425, 209/427, 453, 473; 210/781, 360.1, 360.2, 369, 376, 371, 372, 380.1, 373; 494/56, 65; 422/270, 277

[56] References Cited

U.S. PATENT DOCUMENTS 842,614 1/1907 Blass .

1,119,176 12/1914 Kupke ..... 494/56

FOREIGN PATENT DOCUMENTS 1471598 4/1977 United Kingdom .

*Primary Examiner*—Bernard Nozick

*Attorney, Agent, or Firm*—Pitts & Brittian

[57] ABSTRACT

A solids separator (10) is provided for separating solid particulates according to the density of individual particles. The separator (10) includes a cylindrical container (12) having a container bottom (22) carrying a drive shaft member (28). A cylindrical perforated liner (62) is releasably mounted concentrically within the container (12) on an elevated plate member (70) with an annular liquid jacket (80) being defined by the interior surface of the container and the exterior of the liner. An opening into the top of the container is used to introduce solids into the liner. Provision is made for injecting a liquid under pressure into the container which comprising a liquid source connected with a liquid conduit (46) received in a coaxial passageway (30) in the drive shaft member. A vacuum source, including a vacuum tube (82) mounted independently of the container and extending into the liner, is provided to extract the solid particulates of a specific density from preselected locations within the container. The container (12) is rotatably mounted atop a motor housing (92) and selectively rotated by a suitable motor contained within the housing.

13 Claims, 4 Drawing Figures

SOLIDS SEPARATOR

This is a continuation of application Ser. No. 360,165, filed on Mar. 22, 1982 now abandoned.

DESCRIPTION

1. Technical Field

This invention relates to a solids separator for separating solid particulates according to the density of the individual particles. More particularly, it relates to a separator wherein a suitable liquid is injected into the area containing the particles to create an artifical slurry which enhances the viscosity of the particulate flow. Centrifugal force applied to the slurry facilitates the desired migration and sorting of the particles to preselected radial locations within the separator from which they are extracted.

2. Background Art

Solids separators and filtering devices using centrifugal force have been heretofore known in the art. Typically, such devices are directed toward the removal of suspended particulate matter from a liquid, and do not contemplate the direct insertion of dry solid material into a separator. For example, the solid-fuel separating device disclosed in Schutte U.S. Pat. No. 3,443,696 includes a rotating filter within a stationary housing into which fluid is pumped. Centrifugal and gravitational force causes the solid particles within the fluid to migrate to a trapping filter prior to drawing the fluid from the system.

Certain solids separators known in the art presuppose the injection of a liquid bearing suspended particulate matter, and thus, in separating dry solids, the particles must be suspended in a liquid prior to insertion into the separating device. Further, such devices depend on a filter to determine the particle size to be extracted, with no opportunity afforded the operator to select particles of varying sizes during one operation of the apparatus. Moreover, certain prior art devices are incapable of continuous operation, and the operator must load and unload the particulate matter collected on the filter between operations. If continued operation is possible, the devices are generally limited in function and sorting capability, are expensive to operate, complex mechanically and generally low volume. Examples of related prior art devices are disclosed in U.S. Pat. Nos. 148,513 and 1,025,059.

Other patents dealing with separators include British Pat. No. 1,471,598 and U.S. Pat. Nos. 2,614,134 (Powers), 3,416,662 (Hedrick) and 842,614 (Blass).

The British patent describes a rotatable drum having a concentric liner for supporting solids during rotation of the drum. Provision is made to pass a gas through the liner to fluidize the solids to carry out chemical reactions with the solids after heating the same. This device does not accumulate particles of a specific density at a specific location within the liner to permit removing those particular particles.

The patent to Powers describes a centrifugal filter which deposits particulate material from a slurry upon the inner surface of the basket thereof. No particulate size separation is provided by this device.

In Hedrick, the apparatus is also a solid-liquid separator. There is no provision to concentrate the particles of a desired density to permit their removal independent from other densities.

Similarly, the apparatus of Blass is a centrifugal filter for gross separation of solids from liquids. Because of its construction, there is no density separation of a specific fraction of the solids.

Accordingly, it is an object of the invention to provide a solids separator into which dry solids can be introduced, a synthetic slurry produced, and the solids separated according to the density of individual particle fractions.

Another object of the present invention is to provide a separator capable of continuous operation wherein the operator can selectively extract particles of a desired density from those of other densities during the operation of the separator.

Yet another object of the present invention is to provide a separator which can be inexpensively manufactured.

DISCLOSURE OF THE INVENTION

Other objects and advantages will be more clearly understood by reviewing the drawings and detailed description of the present invention which provides for a solids separator for sorting and collecting solid particulates according to the density of individual particles. The solids separator includes a container provided with cylindrical walls having an interior and exterior surface. This container carries a liner which serves to receive the particles to be sorted and collected. Liquid is injected into the container for passage inwardly through the liner wall to create a slurry with the particles within the liner such that the viscosity of the particulate flow is enhanced. The container and the liner are rotated to generate a centrifugal force upon the particles within the slurry to accomplish the desired sorting and migration of the particles to preselected radial locations within the liner. Means are provided for extracting the particles of a desired density from the preselected locations within the liner to which the particles migrate. In one embodiment, the container is rotatably mounted on the upper portion of a motor housing and selectively rotated by a drive motor contained within the housing. As the container rotates, the solid particles are inserted onto the container liner through an opening and liquid is injected under pressure into the container and forced inwardly through perforations in the container liner. This liquid injection creates an artificial slurry such that the less dense particles tend to move toward the center of the liner and the higher density particles migrate towards the surface of the liner. A vacuum source is then used to draw the particles of a preselected density from the location to which those particles have been sorted according to their density.

BRIEF DESCRIPTION OF THE DRAWINGS

The above-mentioned features of the invention will become more clearly understood from the following detailed description of the invention read together with the drawings in which.

BEST MODE FOR CARRYING OUT THE INVENTION

Figure 2:
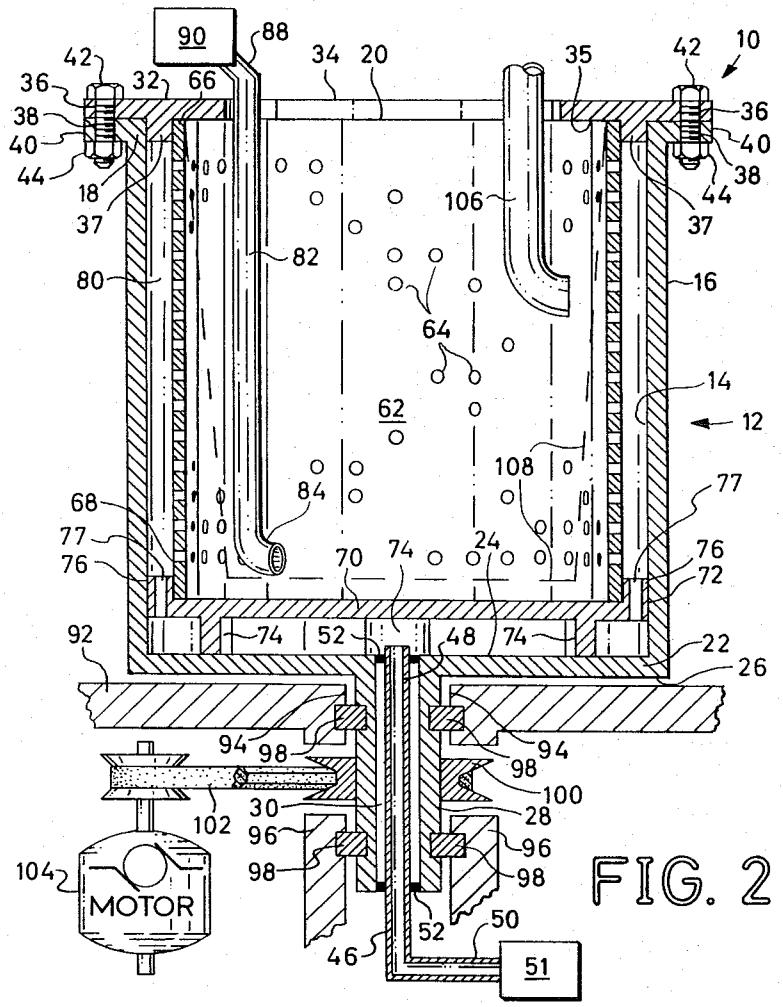
FIG. 2 is a longitudinal cross-section of the solids separator of FIG. 1.
Figure 1:
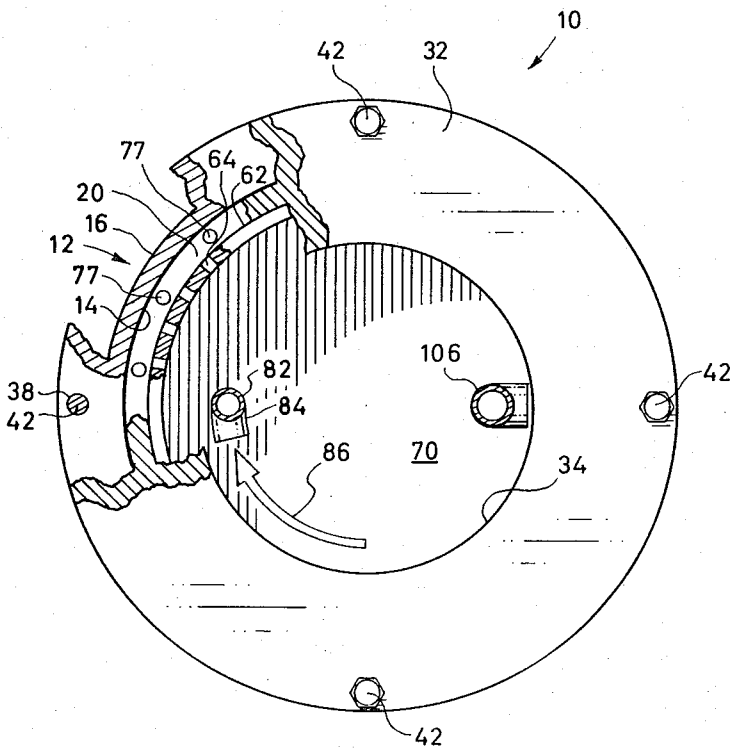
FIG. 1 is a top view, partially in section, of the solids separator which incorporates various features of the invention.

A solid separator incorporating various features of the present invention is illustrated generally at 10 in FIGS. 1 and 2. The illustrated separator 10 includes a container 12 provided with substantially cylindrical walls having interior and exterior surfaces 14 and 16, respectively, and having an upper portion 18 defining an opening 20 and a lower portion defining a container bottom 22 having an interior surface 24 and exterior surface 26. The container bottom 22 carries a drive shaft member 28 provided with a coaxial passageway 30 which terminates at its upper end proximate the upper edge of the container bottom 22.

A container lid 32 having a centrally located opening 34 is provided for the upper portion 18 of the container 12. The lower planer surface 35 of lid 32 carries a circular protruding ridge member 37 having an exterior diameter closely received in the opening 20 of the container 12. The lid 32 has annularly spaced and vertically aligned holes 36 which register with holes 38 in a flange 40 extending radially from the upper portion 18, allowing the lid 32 to be releasably secured on the container 12 by inserting bolts 42 through holes 36 and 38, and securing the bolts 42 with nuts 44. It will be recognized by those versed in the art that other suitable fastener means of securing the lid 32 to the container 12 can be employed.

A means is provided for injecting a liquid into the container. This comprises a liquid conduit 46 having a first end portion 48 which is received in passageway 30 and a second end portion 50 which is connected to a liquid supply means 51 suitable for supplying a liquid under pressure. In order to allow the drive shaft 28 to rotate while conduit 46 remains stationary and to prohibit liquid from escaping the container between the walls of passageway 30 and the conduit 46, a pair of liquid impervious or watertight bearings 52 are provided.

Figure 3:
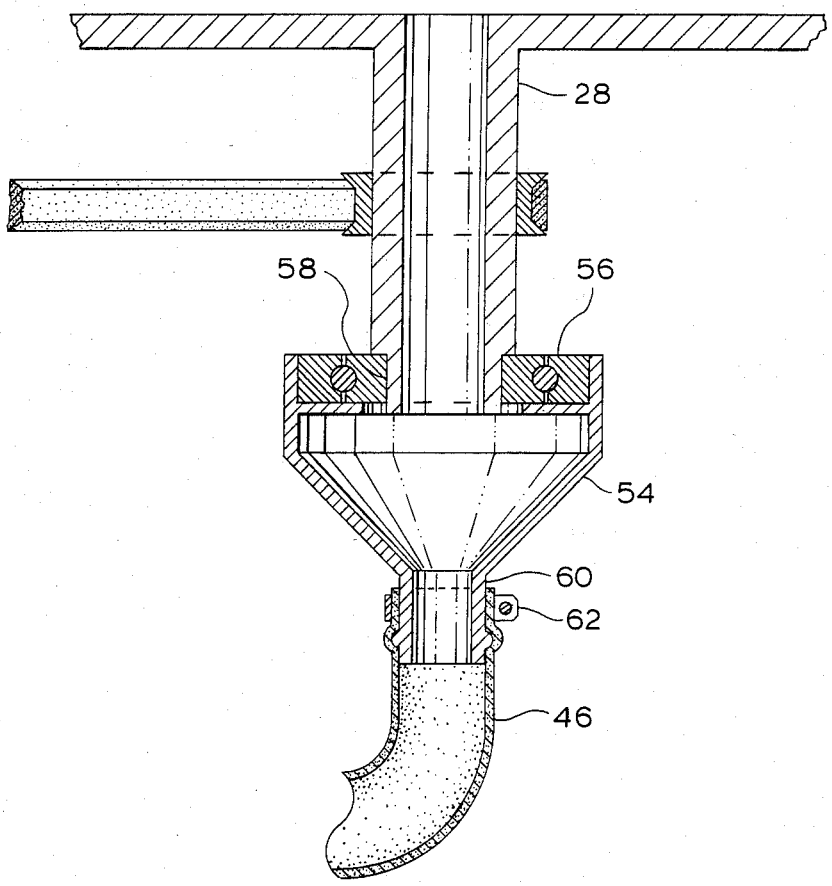
FIG. 3 is an alternate embodiment, in cross-section, of the means for injecting liquid into the container of the solids separator, which is depicted diagrammatically for purposes of clarity.

Alternate means for injecting liquid into the container during rotation are illustrated generally in FIG. 3. More specifically, a funnel shaped coupling member 54 containing a liquid impervious bearing 56 is provided, and drive shaft 28 carries a recessed end portion 58 which is received in bearing 56. The conduit 46 engages the end portion 60 of coupling member 54 and is secured with an adjustable band clamp 62, or other suitable fastener.

Referring again to FIG. 2, in order to support the solids or solid particles during the sorting operation, the separator 10 includes a cylindrical liner 62 within the container. This liner is perforated with a multiplicity of spaced filtering apertures 64. The size of these apertures is less than the largest of the particles to be processed in the separator. This liner includes opened upper and lower end portion 66 and 68, respectively. The liner 62 is releasably mounted on a horizontal plate member 70 which is in turn releasably mounted in the container 12 at a location spaced from the container bottom 22. The plate member 70 defines an exterior edge 72 having a diameter slightly smaller than the diameter defined by the interior surface 14 of container 12. This plate member 70 is provided with leg members 74 which serve to elevate the plate member 70 from the interior surface 24 of container bottom 22 to allow liquid to flow between the plate member 70 and the interior surface 24. The plate member 70 in the illustrated embodiment defines an upturned outer rim portion 76 provided with vertically aligned liquid conduits 77 annularly spaced at preselected intervals. The rim has an outer wall defining the exterior edge portion 72 and an interior wall which closely receives the lower end portion 68 of liner 62 so as to hold the liner 62 in a coaxial position relative to the container 12. Further, the upper end portion 66 of liner 62 is held in a coaxial position with respect to container 12 by the aforementioned ridge member 37 of lid 32. Thus, an annular liquid jacket 80 is defined about the exterior of the liner 62 between the interior surface 14 of the container 12 and the exterior surface of liner 62.

A vacuum tube 82 is provided for removing solids and liquid (slurry components) from a specific radial location within the liner 62. To facilitate interception of the solids and liquid while the container is being rotated, the vacuum tube 82 (see FIGS. 1 and 2) has a first end portion terminating in leg member 84 which extends substantially parallel to the plate member 70, and in a direction opposite the direction of rotation of the container 12 as is illustrated by arrow 86 of FIG. 1. The second end portion 88 of vacuum tube 82 is connected to a vacuum generating source 90 as shown in FIG. 2. The vacuum tube 82 is mounted independantly of the container 12 so as to allow the container and liner to rotate independently of tube 82 as the tube 82 is selectively moved to desired radial locations within the container liner 62 to remove particles having preselected densities.

The container 12 is rotatably mounted atop a motor box housing 92. The housing 92 is provided with upper and lower drive shaft supports or receptors 94 and 96, respectively, with each of the receptors being provided with bearings 98 which rotatably receive the drive shaft 28. The drive shaft 28 is provided with a sheave member 100 which is drivingly connected with a belt 102 to a suitable motor 104 mounted within the housing 92.

In operation, the container 12 is selectively rotated atop housing 92 with loose solid particulates being inserted through the opening 34 in container lid 32. For this purpose, an optional solid feed conduit 106 can be provided as is illustrated in FIGS. 1 and 2. A suitable liquid, either simultaneously or subsequently, is injected into the container 12 within the liquid jacket 80, with such liquid being forced through the apertures 64 in liner 62 at a pressure in excess of the outward centrifugally created pressure within the liner. This creates an "artificial slurry" within the liner which enhances the viscosity of the particle flow. The term "articifical slurry" is used to describe an suspension of particles in a liquid, much as in a slurry, but which would not be a slurry, if the inflow and centrifugal force were removed. Upon rotation of the container, the heavier or more dense particles migrate toward the surface of the liner 62. The lighter or less dense particles position themselves within the slurry at radial positions according to their respective weight or density. The vacuum tube 82 can then be used to draw off liquid and suspended particles of desired density by positioning tube 82 at preselected locations within liner 62, the lighter particles being extracted nearer the axis of the liner and heavier particles being extracted near the liner surface. If the heavier/denser particles which collect on the liner surface are desired, the tube 82 can be used to draw off the undesired liquid and the lighter suspended particulates, and then tube 82 can be used to extract the desired heavier solids. Alternately, of course, rotation of the container can be stopped after removal of the undesired portions, and the separator emptied to retrieve the desired solid particles. It should be noted that it may be desirable to have more than one vacuum tube so as to allow one tube to be used to draw off undesired loose solids and liquid, and one or more other tubes to be used to extract the desired solid/liquid portions.

Further, liners of various shapes may be employed to facilitate the migration of solid particles to different locations within the liner to enhance the sorting and ease of extraction. For example, a conical liner can be used as is depicted by the broken line 108 of FIG. 2, the downward slope of which would vary the migration of heavier loose solids depending on the speed at which the container is rotated. It will also be recognized by those versed in the art that the liner 62 can be used in conjunction with a separate filter and the size of the apertures 64 in liner 62 can be varied as may be dictated by the task to be performed. Also, the type of liquid used can be varied according to the nature of the solid material to be separated, and pulsating liquid pressure can be used to facilitate separation.

Figure 4:
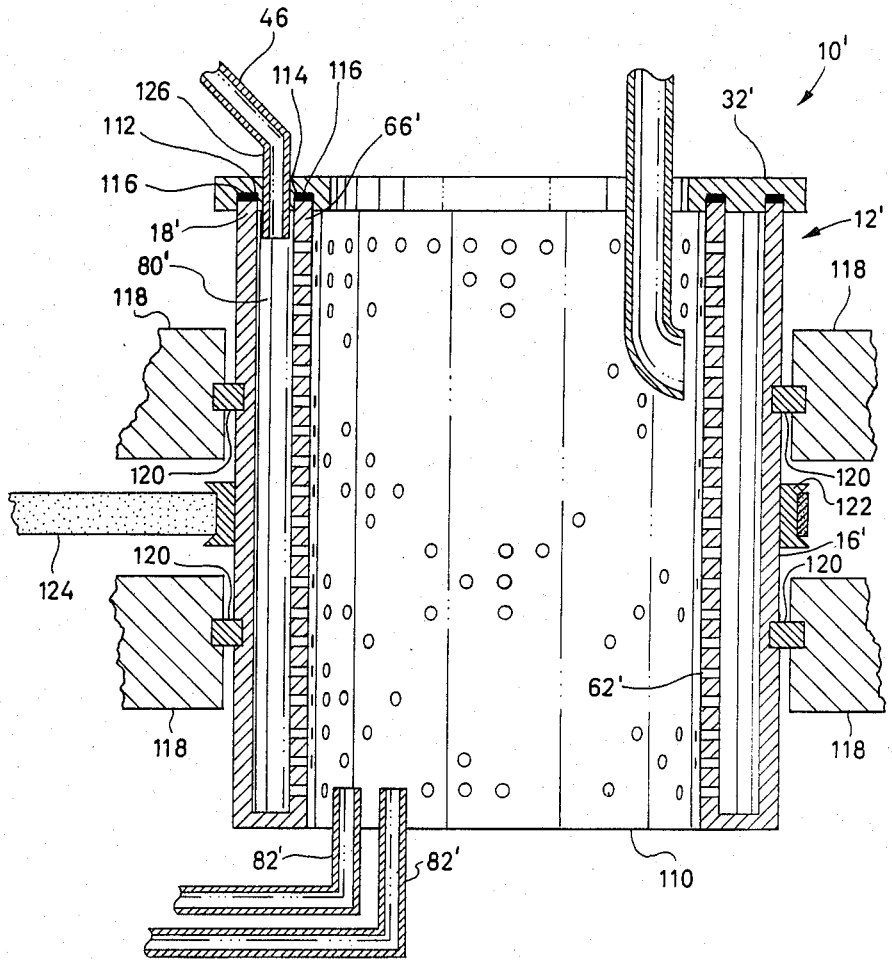
FIG. 4 is a longitudinal cross-section of another alternate embodiment of the solids separator incorporating various features of the invention.

An alternate embodiment of the invention is illustrated generally at 10' of FIG. 4. The primed numbers refer to components which are similar in construction to the embodiments shown in FIGS. 1 and 2. In this embodiment, the container 12' and the perforated liner 62' are integrally joined and define an annular liquid jacket 80' with the bottom portion of the container 12' defining an opening 110. Container lid 32' rotatably receives upper end portion 18' of container 12' and upper end portion 66' of liner 62' in circular recesses 112 and 114, respectively. Each of the recesses 112 and 114 is provided with a liquid impervious or watertight seal 116. The container 12' is rotatably mounted on support members 118 each provided with a bearing 120. A sheave member 122 circumscribes the exterior surface 16' of container 12', the container 12' being selectively rotated by drive belt 124 turn driven by suitable motor means (not shown). Liquid conduit 46' is received in a hole 126 in lid 32' for injecting liquid into the jacket 80' such that, as the container 12' is rotated, the desired particulates of specific densities within the resultant artificial slurry within the liner 62' are separated from heavier or more dense particles. The vacuum tubes 82' in FIG. 4 serve to remove selected density particles and liquid from the location to which they have migrated.

From the foregoing detailed description, it would be recognized that a solids separator having certain advantages over the known prior art has been described and illustrated. More specifically, the illustrated solids separator allows an operator to insert the solid particulate matter into an opening in the top of the apparatus and subsequently inject liquid into the apparatus to form a liquid slurry with enhanced viscosity. This slurry allows the particulates to flow to preselected locations within the slurry due to centrifugal forces as determined by the density of the solids. The solids can then be withdrawn from the container by suitable means such as a vacuum source having an inlet conduit opening positioned at predetermined locations which correspond with the location at which the particulates are sorted according to their density. This insertion and sorting of particulates into the device can be accomplished during a continuous operation and thereby eliminates the need for interruption as has been a common problem with prior art devices. Moreover, in certain applications it may be desirable to use the perforated liner as a filtering apparatus such that particulates can be sorted according to their size and collected on the liner as particulates flow radially outwardly from the axis under centrifugal force.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A solids separator apparatus for sorting and collecting solids according to the density of individual particle fractions, said apparatus comprising:

a container provided with cylindrical walls having interior and exterior surfaces and a bottom wall;

a liner, having interior and exterior wall surfaces, carried concentrically within said container forming an annular jacket with said container about said liner, said liner being provided with apertures along the length thereof extending between said interior and exterior wall surfaces;

means for injecting said solid particles into the interior of said liner;

means for injecting liquid inwardly through said apertures in said liner from said jacket to create an artificial slurry with said particles within said liner;

means for rotating said container and said liner to generate a selected centrifugal force within said slurry to produce migration of particles to preselected radial locations within said liner according to their density and thereby accomplish the desired sorting; and means for removing a selected fraction of particles of a desired density from said slurry at a radial location corresponding to that for said selected fraction.

2. The solids separator of claim 1 wherein said means for injecting liquid comprises liquid conduit means communicating with said annular jacket and a pressurized liquid source communicating with said liquid conduit.

3. A solids separator apparatus for sorting and collecting solid particulates according to the density of individual particles, said apparatus comprising:

a container provided with cylindrical walls having interior and exterior surfaces and having an upper end portion defining an opening and a lower end portion defining a container bottom wall having an interior and exterior surface, said container bottom carrying a centrally located drive shaft member coaxially aligned with the longitudinal axis of said cylindrical walls and extending downwardly from said exterior surface of said container bottom;

a liner carried within said container provided with means for releasably mounting said liner concentrically within said container to form an annular jacket therebetween, said liner being provided with a plurality of apertures along the length thereof extending from an inner wall surface to an outer wall surface of said liner;

means for introducing said solids into the interior of said liner;

means for injecting a liquid through said apertures radially inward into said liner at a pressure greater than pressure within said liner to create an artificial slurry with said particles within said liner;

a motor means connected to said drive shaft for selectively rotating said container and said liner to generate a selected centrifugal force within said slurry to accomplish migration of particles to preselected radial locations in said slurry according to density of said particles and thereby accomplish desired sorting; and vacuum means for extracting said solid particulates of a desired density from said liner at said preselected locations within said liner.

4. The solids separator of claim 3 wherein said means for introducing said solids comprises a solid particulate supply conduit extending through said opening in said upper end portion of said container for introducing said solid particulates into said liner, said supply conduit being mounted independently of said container so as to allow said container and said liner to rotate independently of said supply conduit.

5. The solids separator of claim 3 wherein said liner comprises a cylindrical member provided with a plurality of perforate filtering apertures of preselected diameters, said liner having upper and lower end portions defining openings and having exterior and interior cylindrical surfaces, and wherein said means for releasably mounting said liner within said container comprises a substantially transverse plate member having an exterior edge closely received in said container, said plate member having an upper planar surface for supporting said liner, and a lower planar surface provided with a plurality of leg members extending downwardly and substantially perpendicular to said lower planar surface for elevating said plate member from said internal surface of said container bottom, said plate member further comprising an upturned outer rim portion provided with a plurality of vertically aligned liquid conduits and having an outer wall defining said exterior edge portion of said plate member, and an interior wall to closely receive said lower end portion of said liner to hold said liner in a coaxial position relative to said container with said exterior surface of said liner and said interior surface of said container defining said annular liquid jacket circumscribing said liner.

6. The solids separator of claim 3 wherein said liner comprises a substantially conical member provided with a plurality of filtering apertures therethrough, said liner having an upper end portion defining a first opening, and a lower end portion defining a second opening of a smaller diameter than said first opening.

7. The solids separator of claim 3 wherein said drive shaft is provided with a coaxial passageway, and wherein said means for injecting said liquid into said liner comprises a liquid conduit fashioned to be received in said passageway in said drive shaft, said liquid conduit having a first end portion extending into said container and communicating with said jacket and a second end portion, and liquid supply means connected to said second end portion of said conduit for supplying liquid thereto, said liquid conduit being provided with at least one liquid impervious bearing between said conduit and said passageway in said drive shaft to allow said drive shaft to rotate about said conduit.

8. The solids separator of claim 3 wherein said drive shaft is provided with a coaxial passageway and wherein said means for injecting said liquid includes a coupling member containing a liquid impervious bearing fashioned to rotatably receive the end of said drive shaft member opposite said container bottom, and a liquid conduit being releasably engaged by said bearing member.

9. The solids separator of claim 3 wherein said vaccum means comprises a vacuum tube having a first end portion extending downnwardly into said liner through said opening in said upper end portion of said container for removing said solid particulates of a desired density, and a second end portion, said vacuum tube being movably mounted independently of said container to allow said container and liner to rotate independently of said vacuum tube as said tube is selectively moved to desired radial locations within said liner, and a vacuum generating source connected to said second end portion of said vacuum tube.

10. The solids separator of claim 9 wherein said first end portion of said vacuum tube defines a substantially L-shaped member having a leg member extending in a direction opposite the direction of rotation of said container and liner so as to facilitate interception of said solid particulates of a desired density during rotation of said container and liner.

11. The solids separator of claim 3 wherein said container is provided with a lid portion having a centrally located opening suitable for receiving said vacuum means and suitable for receiving said solid particulates, said lid portion being further provided with means for releasably securing said lid portion to said upper end portion of said container.

12. The solids separator of claim 11 wherein said means for releasably securing said lid portion comprises an annular flange on said upper end portion of said container extending substantially perpendicular from said exterior surface of said cylindrical walls of said container, said flange being provided with a plurality of aligned holes placed at preselected intervals, wherein said lid portion is provided with a plurality of holes placed at preselected intervals corresponding to spacing of said holes in said flange, and a plurality of releasable fasteners received through said holes in said lid portion and said holes in said flange.

13. The solids separator of claim 11 wherein said lid portion further defines a lower planar surface carrying a circular protruding ridge member for extending between said internal surface of said container and said exterior surface of said liner to hold said liner in a coaxial position relative to said container with said exterior surface of said liner and said interior surface of said container defining said annular liquid jacket circumscribing said liner.

* * * * *